United States Patent [19]

Marin et al.

[11] 4,019,640

[45] Apr. 26, 1977

[54] SHEET MATERIAL STACKING AND TRANSFER APPARATUS

[75] Inventors: M. James Marin, South Norwalk; Robert E. Mersereau, Stamford, both of Conn.

[73] Assignee: Pitney-Bowes, Inc., Stamford, Conn.

[22] Filed: June 16, 1975

[21] Appl. No.: 587,388

[52] U.S. Cl. ..... 214/6 H; 271/209; 271/215; 271/218

[51] Int. Cl.[2] ..... B65H 29/22

[58] Field of Search ..... 214/6 H, 6 DK, 6 C; 271/209, 214, 215, 217, 218

[56] References Cited

UNITED STATES PATENTS

| | | | |
|---|---|---|---|
| 1,865,308 | 6/1932 | Evans et al. | 271/209 X |
| 3,107,912 | 10/1963 | Fiehl | 271/215 |
| 3,124,352 | 3/1964 | Weidenhammer | 214/6 H X |
| 3,362,707 | 1/1968 | Lauren | 271/218 |
| 3,410,421 | 11/1968 | Groll | 214/6 DK X |
| 3,548,995 | 12/1970 | Oderman et al. | 214/6 H X |
| 3,679,072 | 7/1972 | Mueller | 271/218 X |

FOREIGN PATENTS OR APPLICATIONS

| | | | |
|---|---|---|---|
| 161,631 | 12/1957 | Sweden | 214/6 H |

*Primary Examiner*—L. J. Paperner

*Attorney, Agent, or Firm*—Peter Vrahotes; William D. Soltow, Jr.; Albert W. Scribner

[57] ABSTRACT

Apparatus for accumulating sheet material in stacked relation on a vertically descending tray and transferring the stack for subsequent processing. An oscillating transfer mechanism is positioned in the path of movement of the tray as it is lowered. The tray and stack is pivoted by cam means into a complemental position with the transfer mechanism and as it passes the transfer mechanism is deposits the accumulated stack on the transfer mechanism. The transfer mechanism is then oscillated to remove the stack. When the stacking tray has assumed its transfer mode, an auxiliary sheet material receiving tray is formed by rotating two vanes from a vertical to horizontal position to receive subsequent sheets. Upon return of the stack tray to its initial position, the vanes are rotated back to their horizontal position dropping the accumulated sheets to the tray. A deflector which decelerates and positions the sheet material in the stack remains in contact with the stack and senses the level of the stack on the descending tray to deactivate the drive lowering the tray to assure that the stack reaches a certain height before transfer is effected.

10 Claims, 3 Drawing Figures

SHEET MATERIAL STACKING AND TRANSFER APPARATUS

BACKGROUND OF THE INVENTION

This invention relates to sheet material handling apparatus, and more particularly, apparatus for stacking a plurality of sheets fed sequentially to the apparatus and transferring the stack for further processing after it reaches a predetermined height.

Various proposals for handling and accelerating delivery of mail have been made. Among such proposals is the opening of the mail envelope at a processing center at its point of origin, reproducing its contents on a facsimile device and transmitting the contents via the facsimile device to a processing center at or near its destination point. Delivery can then be accomplished from the destination processing center, saving considerable handling and shipping time. The original envelope or parcel can then be resealed at the point of origin and stored or returned to the sender as a confirmation copy.

The apparatus of this invention is concerned with the handling of such mail or sheet material after the contents have been copied and transmitted and the original envelope has been resealed.

SUMMARY OF THE INVENTION

In accordance with this invention, the resealed envelopes are fed sequentially to a tray, where they are stacked. The mail pieces are bowed and deflected downwardly by a pivotable deflector which assures proper seating of the envelopes on top of each other and which controls the height of the stack. As the envelopes are stacked, the tray is lowered vertically by a variable speed drive at a continuous rate. The rate of the drive is set to accommodate inputs of the thickest mail piece at a fixed rate without allowing the mail pieces to rise to a jam threshold or fall below the deflector control level. Should the input rate and/or the thickness of the accumulated mail pieces be lower than anticipated, the deflector will fall relative to the level of the stack and actuate a switch to intermittently stop the drive lowering the stack tray to await further sheet material input. The drive is stopped until the input accumulates and moves the deflector upwardly, wherein a second switch can be activated by the deflector to initiate the drive just before the jam threshold is reached. In this manner, the height of the stack is substantially controlled within the prescribed limits after a predetermined time interval, the stack will have reached a certain accumulated height.

After this predetermined time interval, a transfer of the stacked sheets is effected so they can be further processed. For example, the stack can be transferred, tied into a bundle, and moved to a storage bin.

The transfer of the stack is initiated by a control signal to the stack tray drive, which responds by accelerating the downward movement of the stack tray. The tack tray is caused to pivot through the intermediary of a cam follower and cam track during its accelerated downward travel to assume a complemental attitude with an oscillating transfer cradle which is disposed in the path of movement of the stack tray. The stack tray support and transfer cradle are designed to interleave, thereby effecting transfer of the stack as the pivoted tray moves below the transfer cradle. After the descending stack tray deposits the stack in the transfer cradle, the transfer cradle is activated to pivot in a forward direction to remove and effect transfer of the stack. The stacking tray, at the lowest point of its travel actuates a limit switch, reverses, and moves upward to its top position to accept additional sheet material.

While the stack tray is pivoted to its transfer mode, two vanes which are normally part of the vertical side walls of the apparatus are rotated 90° to a horizontal position to receive the input of mail pieces. When the stacking tray returns to its top position it activates another limit switch which again rotates the vanes 90° to a vertical position which allows the accumulated mail pieces to drop to the waiting tray.

Further advantages and details of the invention will become apparent from the following specification and claims, and from the accompanying drawings, wherein:

DESCRIPTION OF THE PREFERRED EMBODIMENT

Figure 1:
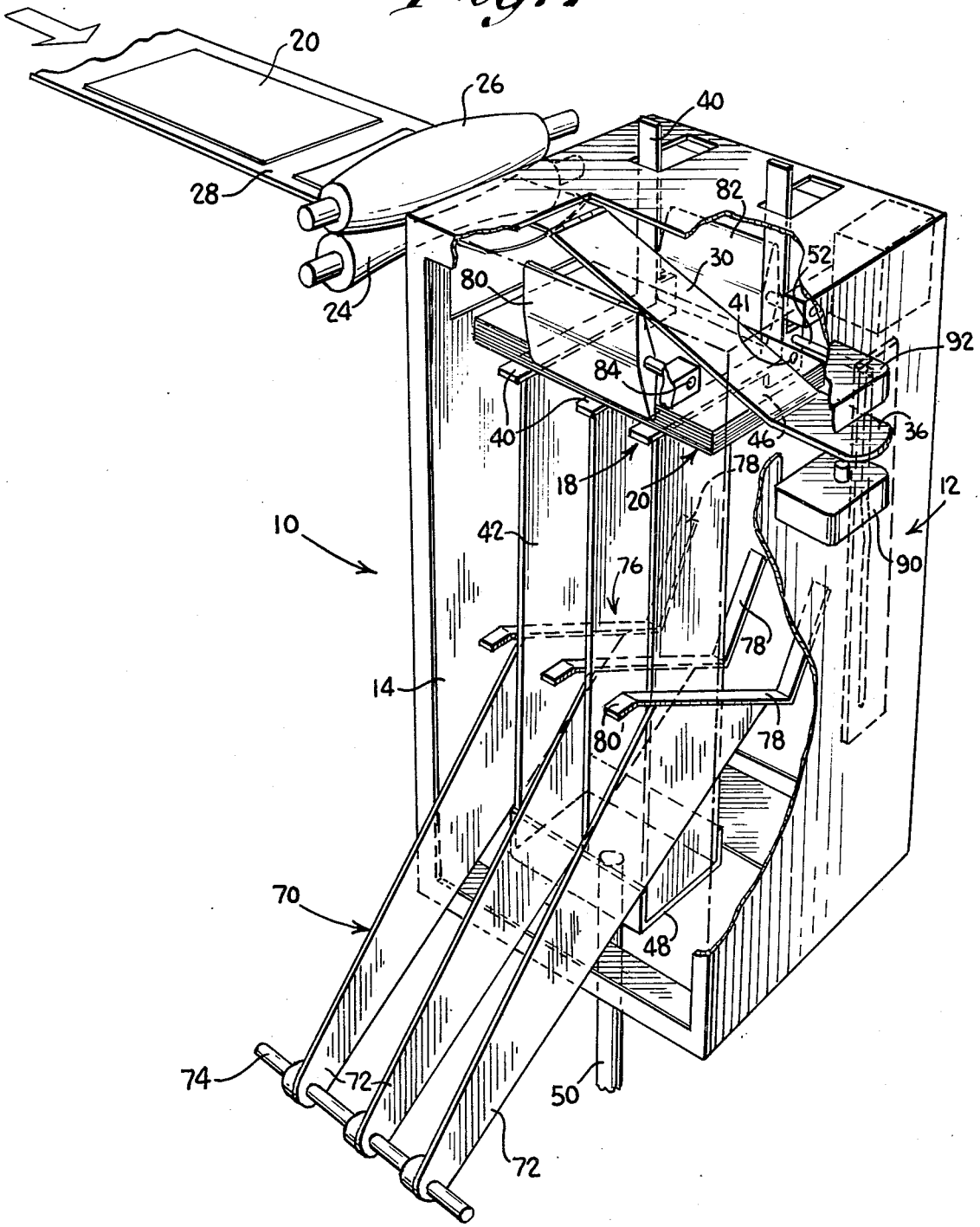
FIG. 1 is a perspective view of the sheet material handling apparatus of the present invention with certain portions broken away to illustrate the interior components of the apparatus.

Referring now to the drawings in detail wherein like numerals indicate like elements throughout the several views, the sheet material stacking and transfer apparatus of the present invention is generally designated in FIG. 1 by the numeral 10. Stacking and transfer apparatus 10 includes a container 12 having an open front face 14 and an opening 16 through its bottom wall or base 13. Reciprocably mounted within container 12 is a stacking tray 18 for sequentially receiving in stacked relation sheets of material 20, such as mail pieces or envelopes containing letters. The sheets or mail pieces 20 are sequentially fed to the stacking tray 18 through an opening 22 in a side wall 23 of container 12 by a pair of oppositely rotating ejector rollers 24, 26 at the end of a conveyor belt 28.

Ejector roller 26 has a convex outer surface while roller 24 has a complemental concave outer surface which are designed in combination to slightly flex, or bow, the mail piece 20 as it passes therebetween. This rigidifies the mail piece 20 as it enters the container 12 through opening 22 for more effective control.

Mail pieces 20 strike a deflector 30 as they enter container 12. Deflector 30 decelerates the ejected mail piece 20 and allows it to settle on the stacking tray 18.

Deflector 30 is pivotably attached at one end by a hinge 32 to a bracket 34 fixed to the interior of side wall 23 of container 12 and extends at an inclined angle across the entire width of container 12. The terminal portion 36 of deflector 30 is substantially horizontal and extends through an opening 38 in the opposite side wall 37 of container 12 for a purpose to be described hereinafter.

Figure 2:
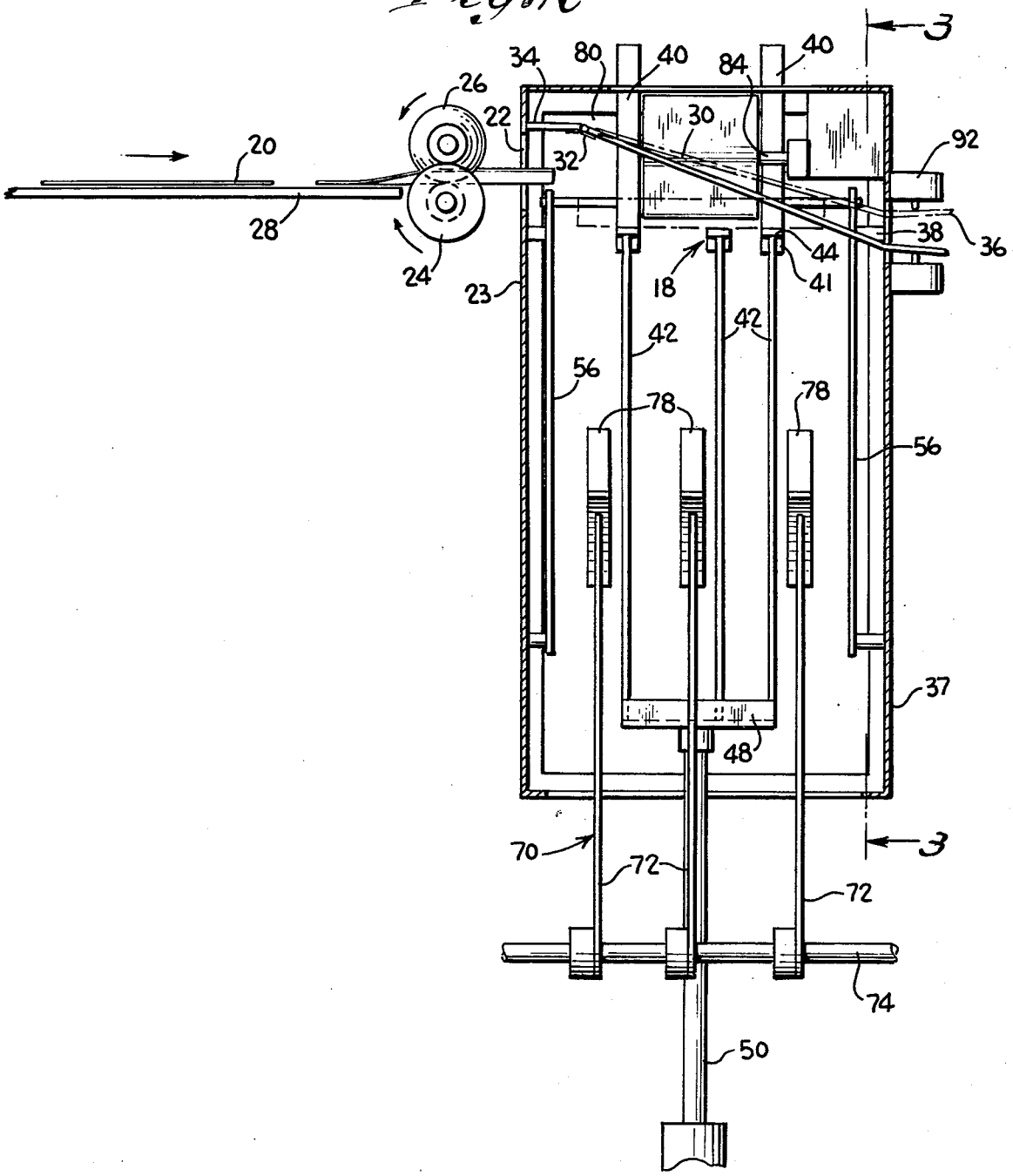
FIG. 2 is a longitudinal cross-sectional view of the apparatus shown in FIG. 1.

Stacking tray 18 consists of three, spaced, arms 40, the outer two arms being L-shaped and the center arm having only one leg of the L as shown. The arms 40 form a stacking cradle or platform for mail pieces 20. A bracket 41 is fixed to each arm 40 at the exterior juncture of the legs of each arm and the brackets 41 each straddle and are pivotably connected by a pin 44 to a lateral extension 46 of an upright support 42. As shown in FIGS. 1 and 2, supports 42 are spaced and fixed to a U-shaped channel 48 connected to a rod 50 extending downwardly through opening 16 in the base 13 of container 12. Rod 50 is connected through intermediate gearing, such as a rack and pinion, to a dual-speed, reversible electric motor (not shown), which when actuated can raise and lower rod 50, channel 48, uprights 42, arms 40, stack tray 18 and the stack of mail pieces 20 received by tray 18.

Figure 3:
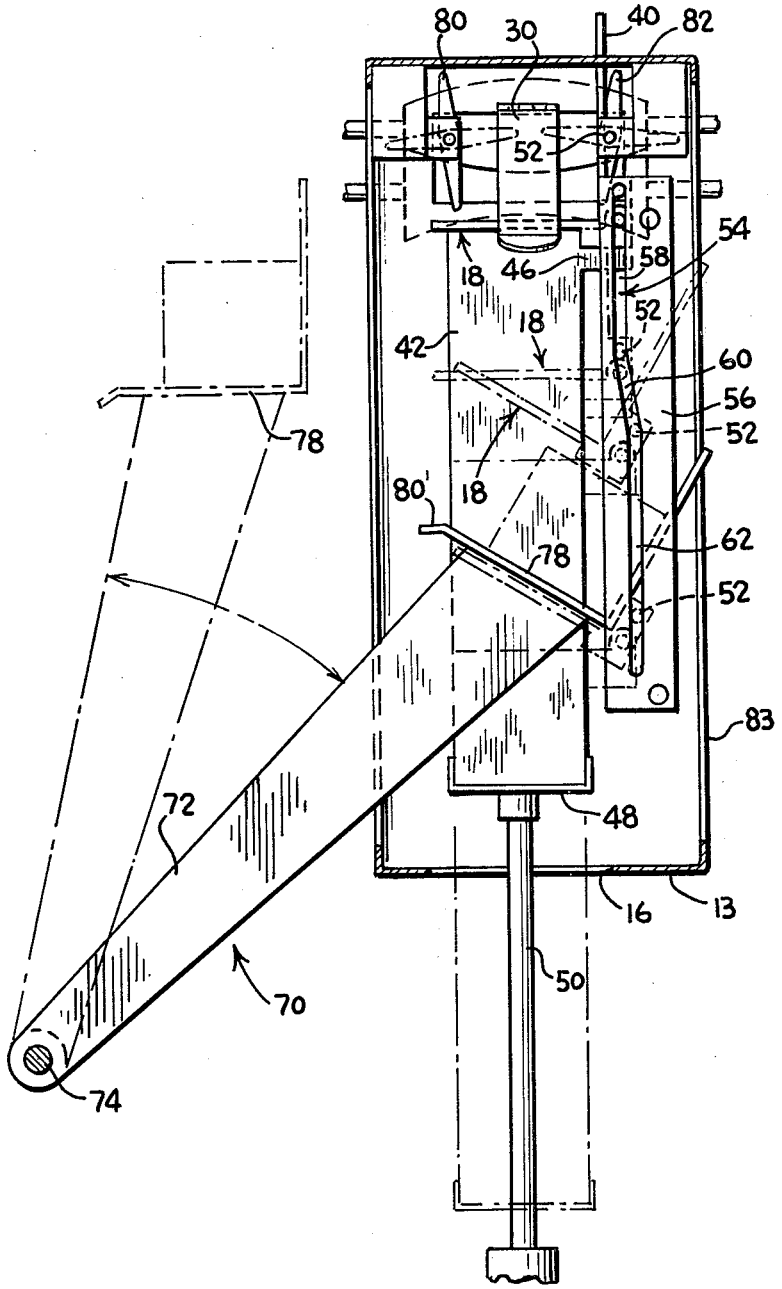
FIG. 3 is a cross-sectional view taken substantially along the plane indicated by line 3—3 of FIG. 2 and illustrating in phantom lines the transfer of the stacked sheet material.

Brackets 41 also have fixed thereto and extending therethrough a pin or cam follower 52 which at its opposite ends is inserted in a cam track 54 formed in plates 56 hung from the opposite interior surfaces of side walls 23 and 37 of container 12. As shown in FIG. 3 stacking tray 18 will remain substantially upright as it is lowered by rod 50 as long as cam follower 52 traverses the vertical portion 58 of the cam tracks 54. As cam follower 52 enters the inclined portion 60 of the cam tracks 54, it pulls each of the arms 40 of stacking tray 18 away from upright supports 42 causing brackets 41 to pivot about pins 44 to assume a canted attitude with respect to the upright supports 42. As stacking tray 18 continues its downward movement through a second vertical portion 62 of cam tracks 54, it remains on its canted attitude until it reaches the lowest point of its travel at the end of the cam tracks 54.

Positioned in a complemental canted attitude to stacking tray 18 in an oscillating transfer mechanism generally designated by the numeral 70.

Transfer mechanism 70 includes three elongated supports 72 interleaved with upright supports 42 for the stack tray 18. At one end, each of the supports 72 is fixed to a rotatable rod 74, which, when rotated oscillates supports 72 as shown in phantom lines in FIG. 3 to effect transfer of the mail pieces 20 from the stack tray 18.

Seated on the opposite ends of supports 72 is a transfer cradle or platform 76 comprising three L-shaped arms 78 of substantially the same height and width as L-shaped arms 40 forming the stacking tray 18. The forwardmost edge portion 80' of each arm 78 is inclined downwardly so that after transfer of the mail pieces 20 from the stack tray 18 is effected, they can be transfered conveniently from the transfer cradle 76 to a feed cradle of a bundle tying machine (not shown) for further processing.

As shown in FIG. 3, the normal position of the transfer cradle 76 is canted or at an angle to the upright stack tray 18. As stack tray 18 is lowered and cam follower 52 enters inclined portion 60 of the cam tracks 54 to pivot arms 40 of the stack tray 18, the arms 40 of the stack tray 18 are interleaved with and assume a complemental canted attitude with the transfer cradle 76. When cam follower 52 enters vertical portion 62 of the cam tracks 54, the arms of stack tray 18 will continue its downward movement through the transfer cradle 76 and transfer the stack of mail pieces 20 to the arms 78 of the stacking cradle 76. Rotation of rod 74 is then initiated and transfer cradle 76 on supports 72 is oscillated to complete the transfer of the stack. The motor drive connected to rod 50 is then reversed and stack tray 18 is returned to its raised position, while transfer cradle 76 is returned to its original position to receive the next accumulated stack of mail pieces 20.

At the time transfer is effected, two vanes 80, 82, normally positioned vertically adjacent the front face 14 and back wall 83 of container 12 are each rotated 90° to a horizontal position to form an auxiliary stack receiving tray for the continuous input of mail pieces 20. Vanes 80 and 82 can be rotated by any suitable mechanical linkage or by a motorized rack in mesh with a pinion mounted on a pin 84 extending from an edge of each vane.

In operation, mail pieces 20 leave an envelope sealing station and are spaced on conveyor 28. They pass through ejection rollers 24, 26 which eject each mail piece 20 through opening 22 into the interior of container 12. Due to the concave and convex surfaces of ejection rollers 24, 26 the mail pieces are slightly flexed or bowed to rigidify them as they enter container 12.

Each mail piece entering container 12 strikes hinged deflector 30 and is decelerated and deflected downwardly by the deflector onto the spaced L-shaped arms 40 forming the platform of stacking tray 18, where they are stacked on top of each other. As the mail pieces 20 are stacked, the stacking tray 18 and its upright supports 42 are lowered vertically by the drive connected to rod 50. The speed of the downward movement of tray 18 is preselected to accommodate continuous inputs of the thickest mail piece 20 (e.g., three folded sheets plus an insert enclosed in an envelope) at a maximum rate on the order of four per second, without allowing the mail pieces to rise to a jam threshold or to fall below contact with deflector 30 which will remain at substantially the same height or level relative to the highest stacked mail piece. Taking into account variations in thickness of the mail pieces 20, it is anticipated that with a linear speed on the order of 0.6 inches per second, seven to 28 mail pieces per inch of stack height can be accumulated on tray 18.

Should the input rate and/or thickness of the accumulated mail pieces be below the anticipated maximum, the downward movement of tray 18 can be temporarily interrupted. In this case, the level of the stacked mail pieces 20 on stack tray 18 will fall below deflector 30 and the extended terminal portion 36 of deflector 30 will fall due to the pivoting of deflector 30 about hinge 32 to strike the contact of a sensor switch 90 hung on the outside of the side wall 37 of container 12. Switch 90 will deactivate the motor drive lowering rod 50. As the mail pieces 20 continue to accumulate on tray 18, the deflector 30 and its extended terminal portion 36 will rise. Just before the jam threshold is reached, terminal portion 36 of deflector 30 will engage the contact of a second sensor switch 92 hung on the outside of the side wall 37 of container 12. Switch 92 will reactivate the motor drive to reinstitute lowering of rod 50 and stack tray 18. In this manner, a certain accumulated height of stacked sheet material is assured after a predetermined time interval.

After this predetermined time interval, (e.g., after the tray 18 has accumulated anywhere from 20 to 65 mail pieces in stack relation, dependng on the thickness of the mail pieces), the transfer of the stack on tray 18 can be initiated by a computerized dump signal sent to the dual-speed, reversible electric motor drive lowering rod 50. Upon receipt of the dump signal the motor drive responds by accelerating the downward movement of tray 18, by increasing its speed from the aforementioned 0.6 inches per second to an average speed of approximately 14 inches per second.

Tray 18 is caused to pivot to assume a canted position as it is lowered during its accelerated movement by cam follower 52 entering the inclined portion 60 of the cam tracks 54. As it is lowered in its canted position, arms 40 pass between the interleaved arms 78 of the transfer cradle 76 positioned in the same canted attitude. The stack of mail pieces or sheet material 20 is smoothly transferred to the arms 78 of transfer cradle 76 as the tray continues its downward movement with cam follower 52 in vertical portion 62 of the cam tracks 54.

As the transfer is taking place, a signal is sent to activate the drive motors (not shown) of the rack and pinion drives to rotate vanes 80 and 82 to a horizontal position to act as an auxiliary stack tray receiving the continuous input of mail pieces 20 from ejector rollers 24 and 26.

After the descending stack tray 18 deposits the stacked mail pieces 20 on the arms 76 of transfer cradle 78, a drive (not shown) is initiated to rotate rod 74 to pivot transfer cradle 78 in forward direction to deliver the stack for subsequent processing. The drive is designed to reverse after delivery to return the transfer cradle to its original position.

When tray 18 reaches its lowermost point of travel, i.e., when cam follower 52 is at the end of vertical portion 62 of the cam tracks 54, the bottom of channel 48 can activate a switch (not shown) to reverse the drive on rod 50 to raise the tray to its initial position. When the tray is returned another control switch can be activated to reverse the drive rotating vanes 80, 82 to return them to their vertical position, causing accumulated mail pieces 20 to drop into arms 40 of tray 18 and to reverse the drive on rod 50 to commence another cycle. The capacity of the auxiliary stacker vanes will be approximately 10 to 12 of the thickest mail pieces in order to accommodate an approximate 2 second transfer cycle.

What is claimed is:

1. Sheet material stacking and transfer apparatus comprising:

means for receiving sheets of material in stacked relation, means connected to said receiving means for lowering said receiving means as said sheets of material are stacked on said receiving means, oscillating means disposed in the path of movement of said receiving means as said receiving means is lowered for removing and transferring said stack of sheet material from said receiving means, means for forming an auxiliary receiving means that is engageable with a major portion of the lower surface of said stack intermediate its ends for subsequent sequentially fed sheet material while said oscillating means removes and transfers previously accumulated sheet material from said receiving means, and means for pivoting said receiving means to a complemental attitude with respect to said oscillating means as said receiving means is lowered towards said oscillating means.

2. Apparatus in accordance with claim 1 wherein said pivot means includes a cam follower connected to said receiving means, and a cam track operatively cooperating with said cam follower.

3. Apparatus in accordance with claim 1 wherein said receiving means and said oscillating means include interleaved platform-forming members for holding said stacked sheet material.

4. Apparatus in accordance with claim 3 wherein said platform-forming oscillating member is canted at an angle with respect to said platform-forming receiving member and means are connected to said platform-forming receiving member for pivoting said member to a complemental attitude with respect to said platform-forming oscillating member as said receiving member is lowered towards said oscillating platform-forming member in order to effect a positive transfer of said stacked sheet material as said interleaved platform-forming members pass each other.

5. Apparatus in accordance with claim 4 wherein said pivot means includes a cam follower connected to said platform-forming receiving member, and a cam track operatively cooperating with said cam follower.

6. Apparatus in accordance with claim 5 wherein said means forming said auxiliary receiving means includes a pair of vanes adjacent said feeding means adapted to be rotated from a vertical to a horizontal position.

7. Apparatus in accordance with claim 1 including means for sequentially feeding said sheet material to said receiving means.

8. Apparatus in accordance with claim 7 wherein said feeding means includes a pair of cooperating rollers for rigidifying said sheet material, one of said rollers having a convex outer surface, the other of said rollers having a concave outer surface.

9. Apparatus in accordance with claim 1 including means for sequentially feeding said sheet material to said receiving means, and means above said receiving means for deflecting said sheet material onto said receiving means.

10. Apparatus in accordance with claim 9 including means for sensing the position of said deflecting means relative to said receiving means, and means responsive to the position of said deflecting means for initiating deactivation and activation of the lowering of said receiving means in order to control the height of the stacked sheet material accumulated on said receiving means prior to its removal and transfer by said oscillating means.

* * * * *